US008931473B2

(12) United States Patent
Baier et al.

(10) Patent No.: US 8,931,473 B2
(45) Date of Patent: Jan. 13, 2015

(54) METHOD FOR CONTROLLING A COOKING POINT OF A GAS OVEN AND DEVICE

(75) Inventors: Martin Baier, Ettlingen (DE); Wolfgang Metzger, Laubach (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 452 days.

(21) Appl. No.: 12/970,061

(22) Filed: Dec. 16, 2010

(65) Prior Publication Data

US 2011/0083663 A1 Apr. 14, 2011

Related U.S. Application Data

(63) Continuation of application No. 12/724,664, filed on Mar. 16, 2010, now abandoned.

(30) Foreign Application Priority Data

Mar. 17, 2009 (DE) ..... 10 2009 014 570

(51) Int. Cl.
*F24C 3/12* (2006.01)

(52) U.S. Cl.
CPC ..... *F24C 3/126* (2013.01)
USPC ..... 126/52; 126/42; 126/39 R; 126/39 BA

(58) Field of Classification Search
USPC ..... 431/6, 18, 29; 126/42, 39 E, 39 R, 126/39 BA, 39 G, 213, 52
See application file for complete search history.

(56) References Cited

U.S. PATENT DOCUMENTS

| | | | | | |
|---|---|---|---|---|---|
| 1,312,655 | A | * | 8/1919 | Whalen | 126/52 |
| 1,421,132 | A | * | 6/1922 | Acuff | 126/52 |
| 2,000,002 | A | * | 4/1935 | Stockmeyer | 251/35 |
| 2,159,658 | A | * | 5/1939 | Hall | 431/6 |
| 2,520,542 | A | * | 8/1950 | Hamilton | 126/52 |
| 2,733,758 | A | * | 2/1956 | Lundgren | 431/61 |
| 2,986,368 | A | * | 5/1961 | Moore | 251/30.01 |
| 3,053,315 | A | * | 9/1962 | Deady, Jr et al. | 137/510 |
| 3,300,174 | A | * | 1/1967 | Urban et al. | 251/29 |
| 3,776,268 | A | * | 12/1973 | Visos et al. | 137/495 |
| 4,129,767 | A | * | 12/1978 | Amagami et al. | 219/626 |

(Continued)

FOREIGN PATENT DOCUMENTS

| | | |
|---|---|---|
| DE | 42 18 278 A1 | 12/1993 |
| EP | 1 887 284 A1 | 2/2008 |

OTHER PUBLICATIONS

Richters et al., DE4218278A1 Description Translation, Dec. 9, 1993, Espacenet, All Pages.*

(Continued)

*Primary Examiner* — Jorge Pereiro
(74) *Attorney, Agent, or Firm* — Alston & Bird LLP

(57) ABSTRACT

In the case of a method for operating a cooking point with a gas burner of a gas hob in which a pan detection is provided for switching off the gas burner when the pan is removed, the pan detection can detect the re-placement of a removed pan onto the cooking point. It then brings about a further operation of the gas burner by igniting the gas burner. When the gas burner is ignited after re-placement of the pan, a power level originally set for the gas burner is only achieved to the full extent with a time delay.

10 Claims, 1 Drawing Sheet

(56) References Cited

U.S. PATENT DOCUMENTS

| | | | | | |
|---|---|---|---|---|---|
| 4,164,644 | A | * | 8/1979 | Remsnyder et al. | 219/433 |
| 4,214,150 | A | * | 7/1980 | Cunningham | 219/447.1 |
| 4,334,145 | A | * | 6/1982 | Norris, Sr. | 219/445.1 |
| 4,441,480 | A | * | 4/1984 | Rickman et al. | 126/42 |
| 4,446,455 | A | * | 5/1984 | Nashawaty | 340/568.1 |
| 4,499,368 | A | * | 2/1985 | Payne | 219/447.1 |
| 4,511,781 | A | * | 4/1985 | Tucker et al. | 219/626 |
| 4,552,330 | A | * | 11/1985 | Grotloh | 251/30.01 |
| 4,577,181 | A | * | 3/1986 | Lipscher et al. | 340/522 |
| 4,681,084 | A | * | 7/1987 | Grech | 126/52 |
| 4,775,913 | A | * | 10/1988 | Ekblad | 361/179 |
| 5,072,095 | A | * | 12/1991 | Hoffmann | 219/432 |
| 5,136,277 | A | * | 8/1992 | Civanelli et al. | 340/568.1 |
| 5,243,172 | A | * | 9/1993 | Hazan et al. | 219/447.1 |
| 5,380,985 | A | * | 1/1995 | Graham | 219/446.1 |
| 5,491,423 | A | * | 2/1996 | Turetta | 324/663 |
| 5,543,784 | A | * | 8/1996 | Mendenhall | 340/568.1 |
| 5,611,327 | A | * | 3/1997 | Teixeira Filho et al. | 126/39 R |
| 5,658,478 | A | * | 8/1997 | Roeschel et al. | 219/502 |
| 5,809,990 | A | * | 9/1998 | Jones et al. | 126/39 N |
| 5,900,174 | A | * | 5/1999 | Scott | 219/447.1 |
| 5,938,425 | A | * | 8/1999 | Damrath et al. | 431/62 |
| 5,945,017 | A | * | 8/1999 | Cheng et al. | 219/446.1 |
| 6,140,617 | A | * | 10/2000 | Berkcan et al. | 219/446.1 |
| 6,168,418 | B1 | * | 1/2001 | Levinson | 431/6 |
| 6,253,761 | B1 | * | 7/2001 | Shuler et al. | 126/42 |
| 6,280,180 | B1 | * | 8/2001 | Fredin-Garcia-Jurado et al. | 431/27 |
| 6,287,108 | B1 | * | 9/2001 | Rothenberger et al. | 431/12 |
| 6,300,603 | B1 | * | 10/2001 | Edwards et al. | 219/447.1 |
| 6,452,136 | B1 | * | 9/2002 | Berkcan et al. | 219/502 |
| 6,462,316 | B1 | * | 10/2002 | Berkcan et al. | 219/502 |
| 6,492,627 | B1 | * | 12/2002 | Ensinger et al. | 219/518 |
| 6,554,197 | B2 | * | 4/2003 | Marbach et al. | 236/20 A |
| 6,619,613 | B1 | * | 9/2003 | Akamatsu et al. | 251/129.04 |
| 6,729,873 | B2 | * | 5/2004 | Neufield et al. | 431/12 |
| 6,805,114 | B2 | * | 10/2004 | Outten et al. | 126/39 E |
| 2002/0113062 | A1 | * | 8/2002 | Cranford | 219/518 |
| 2002/0130190 | A1 | * | 9/2002 | Marbach et al. | 236/20 R |
| 2003/0159688 | A1 | * | 8/2003 | Outten et al. | 126/39 E |
| 2005/0098170 | A1 | * | 5/2005 | Raynor | 126/42 |
| 2007/0125356 | A1 | * | 6/2007 | Crnkovich | 126/39 BA |
| 2007/0175888 | A1 | * | 8/2007 | Wash | 219/448.12 |
| 2010/0192939 | A1 | * | 8/2010 | Parks | 126/39 BA |
| 2011/0146649 | A1 | * | 6/2011 | Brenner | 126/42 |

OTHER PUBLICATIONS

Richters et al., DE4218278A1 Abstract Translation, Dec. 9, 1993, Espacenet, All Pages.*

Richters et al., DE4218278A1 Claim Translation, Dec. 9, 1993, Espacenet, All Pages.*

European Search Report from European Application No. 10156718.8 dated Mar. 1, 2011.

* cited by examiner

METHOD FOR CONTROLLING A COOKING POINT OF A GAS OVEN AND DEVICE

CROSS REFERENCE TO RELATED APPLICATIONS

This application is a Continuation of U.S. application Ser. No. 12/724,664, filed Mar. 16, 2010, now abandoned which claims priority to German Application Number 10 2009 014 570.2, filed on Mar. 17, 2009, the contents of which are incorporated by reference.

FIELD OF THE INVENTION

The invention relates to a method for operating a cooking point with a gas burner, as used in a gas hob. Similarly, the invention relates to a corresponding device.

BACKGROUND OF THE INVENTION

There are known hobs with pan detection at a cooking point, the pan detection detecting whether a pan has been placed on or removed. With the removal of the pan, the cooking point is switched off, but a power level that has been set continues to be maintained. If a pan is then placed on again, the burner ignites immediately and, on account of the pressure conditions in the gas system and the delay of the igniting process, a briefly larger gas flame may occur, even reaching to beyond the handles of the pan. The gas flame will at least be of the size of the level that has been set, possibly even larger because of the briefly larger flame. The user must therefore quickly remove his/her hands from the handles of the pan in order not to be burned by the flame.

Problem and Solution

The invention addresses the problem of providing a method mentioned at the beginning and a corresponding device by which disadvantages of the prior art can be overcome and, in particular, more convenient operation of a cooking point with a gas burner is possible and risk of injury is reduced.

This problem is solved by a method with the features of claim 1 and by a device with the features of claim 16. Advantageous and preferred refinements of the invention are the subject of the further claims and are explained in more detail below. The wording of the claims is incorporated in the description by express reference.

It is provided that, as described above, at the cooking point there is a pan detection, by means of which the gas burner is switched off or a corresponding gas valve on the gas burner is closed when the pan is removed or when the pan detection establishes this. For this purpose, the pan detection may advantageously be formed in the customary way that is known in principle, with capacitive, optical or mechanical systems being suitable in particular. Furthermore, the pan detection together with a control of the cooking point or the gas burner or the gas valve thereof, in particular together with an ignition device for the flame, brings about the effect that the pan detection detects when a pan that has previously been removed is re-placed onto the cooking point. It then reactivates the gas burner by igniting the gas burner and/or opening the gas valve, in order that the cooking process is therefore continued as it were of its own accord after the pan is placed on again.

According to the invention, it is provided that, when the gas burner is ignited, that is to say when the pan has been placed on again, the originally set operation of the gas burner or a power level originally set for the gas burner only takes place or is reached to the full extent after a certain time delay. A user therefore then has time, at least the time of this delay, to remove his/her hands from the pan again, and in this way the risk of burning is reduced or eliminated.

Said delay may advantageously be a few seconds, for example half a second to three or even five seconds. For instance, one to two seconds have proven to be advantageous, in order indeed to allow sufficient time on the one hand for the hands to be removed from the pan and on the other hand for a user to see relatively quickly that the cooking point is in operation again, or in turn in order that the cooking process is also not interrupted unnecessarily long.

According to a first fundamental refinement of the invention, it is possible that the pan detection detects the re-placed pan immediately or only with minimal delay, but the gas burner only ignites at all after said delay of a few seconds. This therefore means that the ignition of the gas burner waits for a short time after detection of the re-placed pan in order that the user can remove his/her hands from the pan. Only after the time delay is the gas burner ignited again. This may take place with a lower power level than that previously set or used. Since, however, a certain time is already available to remove the hands from the pan, re-ignition of the gas burner after the delay may also take place right away with the full power level previously set.

In a fundamentally different refinement of the invention, the pan detection may likewise detect the re-placement of the pan immediately or with minimal delay and also ignite the gas burner immediately or as soon as possible. However, this ignition of the gas burner takes place with a power level which, though high enough that the gas burner reliably ignites, is at the same time well below the power level previously set. This immediate ignition advantageously takes place with the lowest possible power level of the gas burner at which reliable ignition occurs. Then, however, the power level is slowly increased, until the power level previously set is reached. This slow increase of the power level proceeds over the aforementioned time delay and may indeed take the few seconds mentioned.

In the case of this refinement of the invention, the gas burner is therefore ignited immediately when the re-placed pan is detected and when a user in all probability still has his/her hands on the pan. Since, however, the power level used is not the full level previously set, which could possibly lead to burns, but only a lower or the smallest possible level, the risk of burning is in turn reduced or eliminated. By the time the power level is increased to that previously set, the time delay has in turn elapsed and a user has sufficient time to remove his/her hands. A gas flame with a very small or the smallest possible power level will generally not be sufficient to cause burning of the hands holding the pan placed on.

In the case of this refinement of the invention, the power level is possibly increased continuously to the value of the power level previously set. In further possibilities, it may first be increased slowly and then to ever increasing degrees or finally, also at the end of the delay, be increased abruptly.

In a development of the invention, it may be provided that the removal of the pan from the cooking point is optically indicated. For this purpose, indicating means such as illuminating means or the like, for example light-emitting diodes, may be arranged in the region of the cooking point. Furthermore, an acoustic signal output may also take place. A signal output may continue for as long as the pan is removed and at the same time the cooking point has not yet been switched off as a result of a maximum time being exceeded.

In another development of the invention, it may be provided that, after a maximum time is exceeded, possibly in the range between 3 minutes and 15 minutes, advantageously between 5 minutes and 10 minutes, the readiness of the cooking point as it were is cancelled. For this purpose, the power level setting is cancelled. Therefore, when a pan is placed on again, there is no automatic further operation of the cooking point or automatic switching back on of the gas burner. It may be provided in this respect that first an operating element for the power level setting has to be actuated, that is to say a power level setting has to be manually set again. In this way, the control can reliably detect that a user is again in attendance. In particular, it may be provided that the power level first has to be set again right back to zero and subsequently set to the desired degree. Also in this respect it may be provided that such exceeding of the maximum time in the way prescribed is optically and/or acoustically indicated.

In another development of the invention, it may be provided as an additional safety feature that a signal is output shortly before the gas burner is re-ignited or shortly before the previously set power level is reached. This may be an optical signal or advantageously an acoustic signal. Such a signal may, for example, be generated half a second or a second before the power level originally set is reached when the pan is placed on again and the gas burner is automatically ignited.

In another development of the invention, it may be provided that, when the cooking point is switched off or the gas burner is turned off, in particular when a placed-on pan is removed, a slow turning-off operation takes place, or the power level is as it were slowly brought to zero. This may last a number of seconds, for example two seconds to five seconds. Furthermore, it may at the same time be indicated, once again optically and/or acoustically in the aforementioned way. In particular, such slow turning off may also mean that, after the pan is removed, said few seconds are waited before the power level is brought down or the gas burner is turned off. As a result, the gas burner is not switched off unwantedly, if for example as a result of malfunctions or the like a pan is briefly not detected as placed-on.

A control in which both the pan detection and the control for the gas valve of the gas burner are integrated together with measurement of the time or the delay may possibly be provided in a central control of a corresponding gas hob. Alternatively, it may be designed as an additional control for certain cooking points.

The output of a signal, in particular an acoustic signal, before the ignition of the gas burner may have the advantage that, in the case where an object other than a pan has been placed on, for example a cooking spoon or the like, this is detected and an operator is warned of the imminent ignition of the gas burner. Then the object inadvertently placed on can be removed again and an accident avoided.

These and further features emerge not only from the claims but also from the description and the drawings, where the individual features can be realized in each case by themselves or as a plurality in the form of subcombinations in an embodiment of the invention and in other fields and can constitute advantageous and inherently protectable embodiments for which protection is claimed here. The subdivision of the application into individual sections and subheadings do not restrict the general validity of the statements made thereunder.

BRIEF DESCRIPTION OF THE DRAWINGS

Exemplary embodiments of the invention are illustrated schematically in the drawings and are explained in greater detail below. In the drawings.

DETAILED DESCRIPTION OF THE EXEMPLARY EMBODIMENTS

Figure 1:
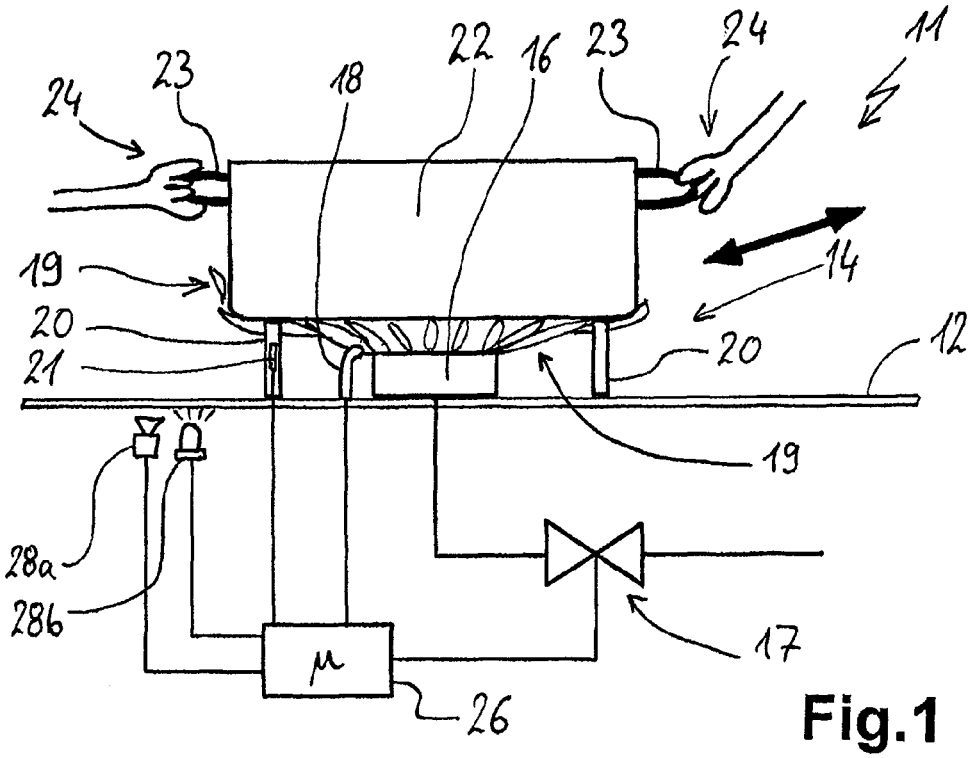
FIG. 1 shows a side view of a gas hob according to the invention with a device for the time-delayed ignition of a gas burner of a cooking point and FIG. 2 shows a diagram of the power progression over time for various ways of increasing the power.

FIG. 1 illustrates a gas hob 11 as a device according to the invention, on which the method according to the invention can be carried out. The gas hob 11 has a conventional hob panel 12, and a cooking point 14 thereof is illustrated. The cooking point 14 has a conventional gas burner 16 with a gas valve 17 arranged under the hob panel 12, from which valve said burner is supplied. Provided at the gas burner 16 is an ignition device 18 and advantageously a monitoring device (not illustrated) for the gas flames 19. An essentially conventional pan support 20, on which a pan 22 is placed over the gas burner 16 and the cooking point 14, is also provided. This pan support has yet further functions, as still to be explained below. As usual, the pan has side handles 23, which are being gripped by hands 24 of the user, for example because said user has just placed the pan 22 on again.

Provided on the gas hob 11 is a control 26, which is connected not only to the gas valve 17, for the activation thereof, and to the ignition device 18 but also, though not of any consequence here, to a possible flame monitor. Furthermore, the control 26 is connected to a pan detection device, which is not described in any more detail but is formed as a known reflex light barrier and is arranged underneath the hob panel 12. Furthermore, the control 26 is connected to signal transmitters under the hob panel 12, to be precise an acoustic signal transmitter 28*a* and an optical signal transmitter 28*b*. It is also possible to omit the signal transmitters or to provide only one of the two.

Figure 2:
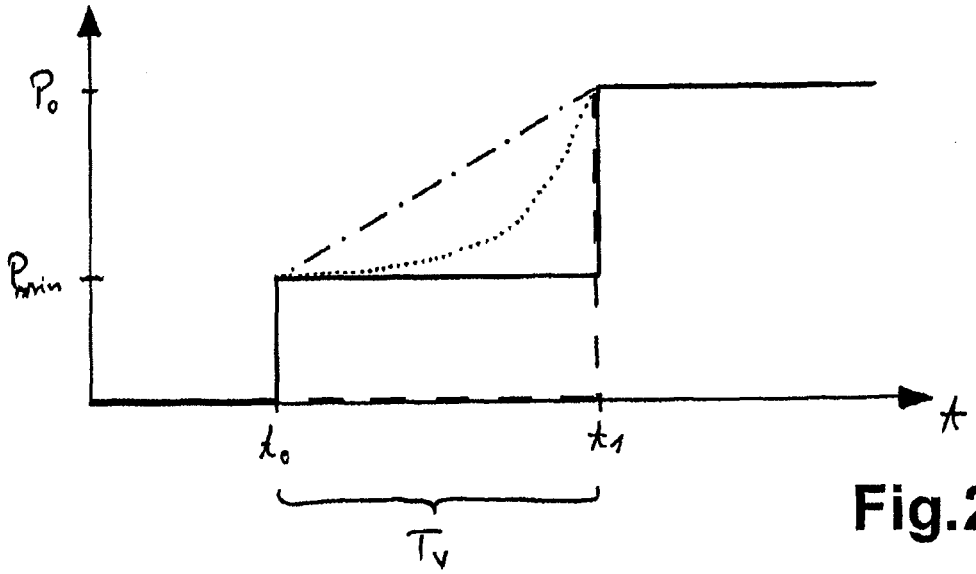

When the pan 22 is removed from the cooking point 14, as the thick arrow indicates, the pan detection device 21 together with the control 26 detects this. The latter then closes the gas valve 17, so that the gas burner 16 goes out or the gas flames 19 are extinguished. If the pan 22 is then placed on again with the hands 24 on the handles 23, the pan detection device 21 detects the pan 22. This then corresponds to the point in time $t_0$ in the diagram of the power P over the time t according to FIG. 2, to be specific when the power of the gas burner 16 is increased from zero, that is when the gas valve 17 is closed. Here there may be an abrupt increase according to the solid line to a power $P_{min}$, which is chosen such that it is the minimum power or minimum power level or minimum amount of gas with which the gas burner 16 can ignite and burn. Up until the point in time $t_1$, which is reached after a delay time $T_V$, which is the delay time mentioned at the beginning, there may be a few seconds, advantageously one to two seconds. Over this delay time $T_V$, the power P is then not increased over the minimum power $P_{min}$, as shown by the solid line. This only happens abruptly at the point in time $t_1$, and then specifically to the power originally set $P_0$. This power $P_0$ was the power before the pan 22 was removed. During the delay time $T_V$, an operator therefore has sufficient time after placing the pan 22 onto the cooking point 14, that is the said one to two seconds, to remove the hands 24 again from the region in which the gas flames 19 can come. Although the gas burner 16 ignites again, the gas flames 19 scarcely reach over the base of the pan 22 to the sides and up to the handles 23 or the hands 24, since said burner operates with the lowest possible minimum power.

As an alternative to keeping to the minimum power $P_{min}$ along with an abrupt increase, the power may, as from the point in time $t_0$, first increase slightly and then ever more quickly as shown by a dotted curve in the manner of a parabola or non-linearly. As a result, it can also at the same time be signalled to a user that not only has re-ignition taken place but there has also been an increase in the power automatically beyond the minimum power $P_{min}$. The user therefore does not have to worry that the cooking point 14 is malfunctioning.

In another alternative refinement, the increase as from the point in time $t_0$ may take place uniformly as shown by the dash-dotted representation. Although an increase in the burning power once again takes place here somewhat more quickly than in the case of the two previous curves, it is still always in such a way that, for example after the elapse of a time $T_V/2$ after the point in time $t_0$, there is still a much lower power than the power previously set $P_0$.

In yet a further alternative refinement of the method, at the point in time $t_0$, the gas burner 16 is still out or the gas valve 17 is closed. Only at the point in time $t_1$, that is after the delay time $T_V$, is the gas burner 16 ignited by opening of the gas valve 17 and actuation of the ignition device 18, then however right away as shown by the dashed curve with the full pre-set power $P_0$. This has the advantage that even a possibly existing risk of burning caused by a gas flame with the low minimum power $P_{min}$ is eliminated, since indeed there are still no gas flames 19. At the same time, it must then be noted however that the re-ignition of the gas burner 16 at the point in time $t_1$ then takes place with the full pre-set power $P_0$ and abruptly.

As explained at the beginning, an acoustic and/or optical signal output by the signal transmitters 28*a* and 28*b* may take place at a point in time $t_0$, $t_1$ or a point in time in between. This may signal re-ignition of the gas burner 16, that the full power previously set $P_0$ will soon be reached or has been reached, or something similar.

The invention claimed is:

1. A method for operating a cooking point with a gas burner of a gas hob, a pan detection for switching off the gas burner or closing a corresponding gas valve when the pan is removed being provided at the cooking point, the pan detection detecting when a removed pan is re-placed onto the cooking point and bringing about renewed operation of the gas burner by igniting the gas burner or opening the gas valve, wherein, when the gas burner is ignited after the pan is placed on again, the originally set operation or a power level originally set for the gas burner only takes place to the full extent after expiration of a time delay, wherein the delay is half a second to five seconds, wherein the pan detection detects immediately when a pan is placed on again and only ignites the gas burner again after the time delay, and wherein a re-ignition of the gas burner after the delay takes place with the power level previously set.

2. The method as claimed in claim 1, wherein the state of removal of the pan from the cooking point is optically indicated.

3. The method as claimed in claim 2, wherein the state is optically indicated by illuminating means lying in the region of the cooking point.

4. The method as claimed in claim 1, wherein a signal is output before re-ignition of the gas burner.

5. The method as claimed in claim 4, wherein the signal is an acoustic signal.

6. The method as claimed in claim 1, wherein, after a maximum time is three minutes to fifteen minutes, the power level setting is cancelled and operation of the cooking point when the pan is placed on again does not take place automatically but instead a power level is manually set again.

7. The method as claimed in claim 6, wherein the power level is set by manually resetting the power level to zero and subsequently increasing the power.

8. The method as claimed in claim 1, wherein slow turning-off with a turning-off time of a few seconds is provided for switching off the cooking point or turning off the gas burner.

9. The method as claimed in claim 8, wherein the turning off takes place with an optical and/or acoustic indication taking place at the same time.

10. A device for carrying out the method as claimed in claim 1 with a gas burner, pan detection means at the gas burner and a gas valve for the gas burner.

* * * * *